US005911180A

United States Patent [19]

Mullens

[11] Patent Number: 5,911,180

[45] Date of Patent: Jun. 15, 1999

[54] KNOCK-DOWN (UNASSEMBLED) INTERLOCKING SHELF UNIT

[76] Inventor: Gordon E. Mullens, 29924 Big Range Rd., Canyon Lake, Calif.

[21] Appl. No.: 08/700,864

[22] Filed: Aug. 21, 1996

[51] Int. Cl.[6] ..... A47B 3/06

[52] U.S. Cl. ..... 108/153.1; 108/180

[58] Field of Search ..... 108/153.1, 100, 108/186, 193, 25

[56] References Cited

U.S. PATENT DOCUMENTS

| | | | |
|---|---|---|---|
| D. 090,164 | 6/1933 | Ogden . | |
| D. 168,455 | 12/1952 | Johnson . | |
| D. 213,114 | 1/1969 | Rzetelny . | |
| 1,689,645 | 10/1928 | Turk | 108/186 |
| 2,366,677 | 1/1945 | Rosenthal | 108/180 X |
| 3,029,056 | 4/1962 | Breglia . | |
| 3,090,086 | 5/1963 | Fata . | |
| 3,241,885 | 3/1966 | Deaton | 108/186 X |
| 3,250,584 | 5/1966 | Tassell . | |
| 3,265,344 | 8/1966 | Ornstein . | |
| 3,280,527 | 10/1966 | Faust . | |
| 3,648,393 | 3/1972 | Parrilla . | |
| 3,652,048 | 3/1972 | Hartman . | |
| 4,651,651 | 3/1987 | Sheffer | 108/180 |
| 5,022,721 | 6/1991 | Melgers | 108/180 X |
| 5,081,936 | 1/1992 | Dreiling | 108/25 X |
| 5,345,882 | 9/1994 | Yamada | 108/193 |
| 5,454,331 | 10/1995 | Green | 108/193 X |
| 5,536,108 | 7/1996 | Kvalheim | 108/180 X |

*Primary Examiner*—Jose V. Chen
*Attorney, Agent, or Firm*—Andrew A. Abeyta

[57] ABSTRACT

A wall shelf unit 100 that can be specially adapted as a decorative plate shelf unit 300. The wall shelf unit 100 generally comprises an elongated shelf member 20 with at least one shelf support member 40, or corbel, that interlocks with shelf member 20 in a substantially perpendicular fashion. Shelf support member 40 comprises a tongue 44, preferably a male French dovetail, formed at one end thereof. Shelf member 20 comprises a groove 21, preferably a female French dovetail, formed in an underside surface thereof and that extends substantially across the width of shelf member 20 to receive tongue 44 of shelf support member 40. Tongue 44 engages groove 21 by sliding into groove 21 to form an interlocking shelf unit 100. Because the wall shelf unit 100 can be packaged and sold in a knock-down configuration and flat packed, which can be quickly and easily assembled by a consumer, it minimizes the storage stocking or distribution space required of a vendor.

10 Claims, 4 Drawing Sheets

KNOCK-DOWN (UNASSEMBLED) INTERLOCKING SHELF UNIT

I. BACKGROUND OF THE INVENTION

The present invention relates generally to the field of horizontally-supported planar surfaces and connections in wood working where fine joinery is desired. More specifically, the present invention relates to a shelf unit that has a shelf member with at least one mortise or groove formed in a portion of the underside surface thereof, the groove being formed to receive a cooperating tenon or tongue of a shelf support member, or corbel, to form an interlocking shelf unit.

Generally, wall shelf units are sold or advertised in a retail vendor's display case that holds several assembled wall shelf units, thus requiring a significant amount of storage, stocking, or distribution space of a vendor and reducing the volume of goods that can be made available to consumers from a manufacturer. Such wall shelf units are typically sold or advertised in an already-assembled fashion. Consequently, the industry practice is to design and use a display case that holds several already-assembled wall shelf units, rather than redesign the wall shelf units to be displayed and sold in a "knocked-down" or collapsible/unassembled configuration. Thus, it is desirable to minimize the storage, stocking, or distribution space required of the vendor so that a higher volume of the wall shelf units can be distributed, thereby resulting in increased profits. For the foregoing reasons, wall shelf units should be capable of being knocked-down or readily collapsed so that they can be packaged and stacked one on top of another to optimize the distribution space allocated by a particular vendor.

The "French dovetail" and groove woodworking joint has been employed by those skilled in the art for many centuries in assembling, for example, drawer systems and wood components. For example, Parrilla, U.S. Pat. No. 3,648,393, *Interconnected Picture Frames,* and Fata, U.S. Pat. No. 3,090,086, *Tapered Dove-Tail Joints,* depict interconnections employing a variety of dovetail joints, including tapered dovetail joints. The prior art is replete with wall shelves that have been used for support surfaces and decorative purposes. Examples include the following patents.

Hartman, U.S. Pat. No. 3,652,048, *Vertically Adjustable Wall Bracket Assembly for Mounting a Shelf,* depicts a wall bracket assembly for mounting a shelf. A disadvantage of this type of groove and screw connection is that the set screws, which are screwed into the bottom side of shelf board, must be accurately mounted to the shelf board (at the same vertical height) or they will engage the shelf supporting bracket in different planes or vertical heights, thus effecting an uneven engagement between the shelf board and the shelf support bracket. Another disadvantage is that a gap can be formed between the shelf board and the shelf supporting bracket if the heads of the set screws are not in the same plane. Yet another disadvantage of this type of groove and screw connection is that the shelf board and the shelf supporting bracket can become separated or broken away at the points of contact between the set screws and the groove.

Faust, U.S. Pat. No. 3,280,527, *Axially Extensible Column Construction with Upper Tubular Bearing Cap,* depicts one or more vertically adjustable shelves that can be provided on an elongated support member, which is adapted to be positioned between the floor and ceiling. The tongue and groove in Faust, however, are not used in the construction of the shelf itself. Rather, the tongue and groove assist in vertically adjusting the shelf along the support member.

Ornstein, U.S. Pat. No. 3,265,344, *Furniture Construction,* depicts a shelf arrangement wherein a shelf panel (not shown) is supported by a shelf bracket that is adjustably mounted on a vertical standard for a variable height shelf panel. The shelf bracket is mounted to the vertical standard by a comparatively-complicated screw-threaded bore attachment means. A disadvantage of Ornstein is that the shelf panel is not mechanically secured to the shelf bracket; it is secured to the shelf bracket by adhesives between the shelf bracket and the shelf panel.

The present invention discloses a joint and a shelf unit utilizing the joint, with a mortise (groove or recess) formed in a portion of the flat underside surface of a shelf member, the mortise engaging or receiving a tenon formed at one end of a corbel or shelf support member to effect strong mechanical engagement between the shelf member and the shelf support member. The present invention offers a cost savings to vendors in the area of storage, stocking, or distribution space requirements while still making it consumer friendly.

II. SUMMARY OF THE INVENTION

The present invention generally comprises a shelf unit, specially adapted as a decorative plate shelf. The shelf unit comprises a shelf member with at least one shelf support member, or corbel, that interlocks with the shelf member in a substantially perpendicular fashion. The shelf support member comprises a rigid tenon (projection) or tongue, preferably a male French dovetail portion, integrally formed at one end thereof. The shelf member comprises a mortise or groove, preferably a female French dovetail portion, formed in a flat underside surface of the shelf member and that extends substantially across the width thereof to receive the tongue of the shelf support member. The groove of the shelf member is open to the rear edge (a first edge opposing a second edge) of the shelf member only as shown in FIG. 2. The shelf support member engages the shelf member as a result of the tongue moveably sliding into the groove to form an interlocking shelf unit.

The shelf unit comprises a shelf member, the shelf member having a plurality of mortises formed in an underside surface of the shelf member, the plurality of mortises extending from a first edge of the shelf member and being open to the first edge of said shelf member, the plurality of mortises being closed at a predetermined location with respect to the first edge of the shelf member thereby defining a length for each of the plurality of mortises; a plurality of shelf support members, each of the plurality of shelf support members having an upper end, each of the upper ends having a tenon integrally formed thereon with a tenon surface, each of the tenons having an enlarged head portion and a reduced neck portion, each of the tenons having a corresponding mortise selected from the plurality of mortises, each of the tenons being slidably engaged and carried by its corresponding mortise, the plurality of shelf support members, with respect to the shelf member, being removable in a first (horizontal) plane and immovable in a second (vertical) plane; and the plurality of shelf support members, with respect to the shelf member, being immovable in the first and second planes when affixed against a surface, such as a wall; and attachment means for attaching said shelf unit to the surface.

The present invention discloses a joint for interlocking furniture pieces, comprising a mortise formed in a portion of a surface of a first member, the mortise extending from and being open to one edge only of said first member (opposing a second edge not having a groove formed therethrough);

and a tenon integrally formed on one end of a second member, the tenon conforming to and having the same dimensions as the mortise; the mortise slidably engaging and capturing the tenon to form an interlocking unit; and the second member, with respect to the first member, being removable in a first (horizontal) plane and immovable in a second (vertical) plane.

Because the present invention can be sold in a "knock-down" configuration and packaged in a "flat packed" configuration, which is quickly and easily assembled by a consumer, the present invention minimizes the storage stocking or distribution space required of a vendor while still making it consumer friendly. All components of shelf unit 100 are separable.

The novel features of the present invention will become apparent to those of skill in the art upon examination of the following detailed description of the invention or can be learned by practice of the present invention. It should be understood, however, that the detailed description of the invention and the specific examples presented, while indicating certain embodiments of the present invention, are provided for illustration purposes only because various changes and modifications within the spirit and scope of the invention will become apparent to those of skill in the art from the detailed description of the invention and claims that follow.

III. BRIEF DESCRIPTION OF THE DRAWINGS

The accompanying figures, in which like reference numerals refer to like elements throughout the separate views and which are incorporated in and form part of the specification, further illustrate the present invention and, together with the detailed description of the invention, serve to explain the principles of the present invention.

IV. DETAILED DESCRIPTION OF THE INVENTION

Figure 1:
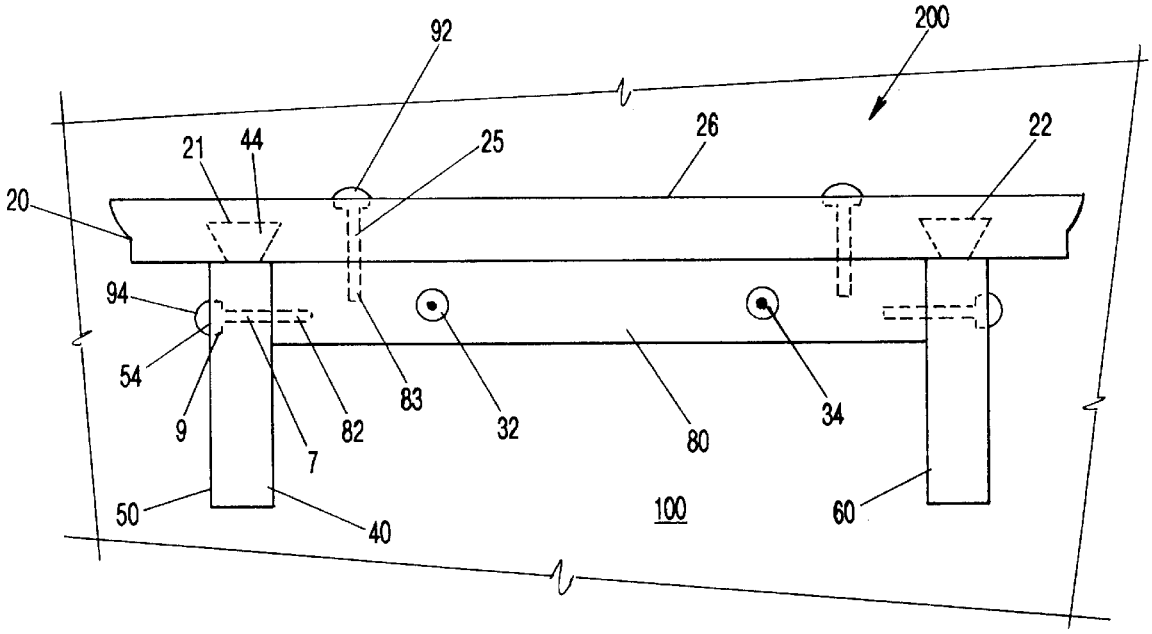
FIG. 1 is a front view of the assembled shelf unit in accordance with the present invention.

Referring to FIG. 1, the present invention generally comprises shelf unit 100 that can be affixed to or against a supporting surface, such as wall 200. Shelf unit 100 of the present invention comprises shelf member 20 with at least one shelf support member 40, or corbel, which it is desired to securely connect by the tongue-and-groove joint of the present invention. Shelf support member 40 interlocks with shelf member 20 in a substantially perpendicular fashion as illustrated in FIG. 1. All components of shelf unit 100 are separable, e.g., shelf member 20 is horizontally separable from shelf support member 40. When fully assembled, flat upperside surface 26 of shelf member 20 operates as a bearing or support surface for placing objects thereon.

As shown in FIG. 1, shelf support members 40 and 60 are spaced apart at predetermined distances. Shelf support members 40 and 60 are substantially parallel with respect to each other. The construction of shelf support members 40 and 60 is substantially identical, as are their corresponding mortises 21 and 22 (shown in FIG. 2), with the exception that shelf support member 40 is a mirror image of shelf support member 60, and vice versa, such that the two members are adapted to be positioned at opposite ends of shelf member 20. Thus, a description of shelf support member 40 and mortise 21 suffices as a description of both shelf support members 40 and 60 and mortises 21 and 22, respectively. A mortise, as is known in the art, is a cavity, groove, or recess, usually rectangular, in a piece of wood prepared to receive a similarly-shaped projection or tenon. A tenon, as is known in the art, is a projection on the end of a piece of wood shaped for insertion into the mortise.

Figure 2:
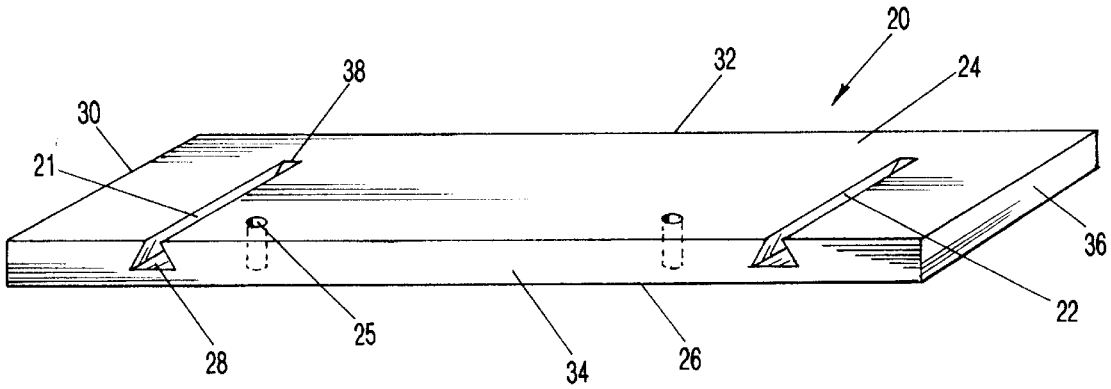
FIG. 2 is an inverted (upside down) perspective view of the shelf member in accordance with the present invention.

Referring to FIG. 2, which is an inverted (upside down) view shelf member 20, shelf member 20 has a flat upperside surface 26 and a flat underside surface 24. Shelf member 20 comprises groove 21 formed in underside surface 24, preferably a female French dovetail portion, for capturing a tongue 44 (discussed in detail below). Groove 21 is of uniform depth throughout and has a dovetail cross section when taken along view line A—A in FIG. 4. In practice, groove 21 is formed to extend substantially across the width of shelf member 20; groove 21 is open to one edge, the rear edge 34, of shelf member 20, i.e., groove 21 does not extend the entire width of shelf member 20. Groove 21 extends from rear edge 34 of shelf member 20 to a predetermined stopping point 38 of shelf member 20. The edges 30, 32, and 36 of shelf member 20 can be utilized for decoration or styling.

Figure 3:
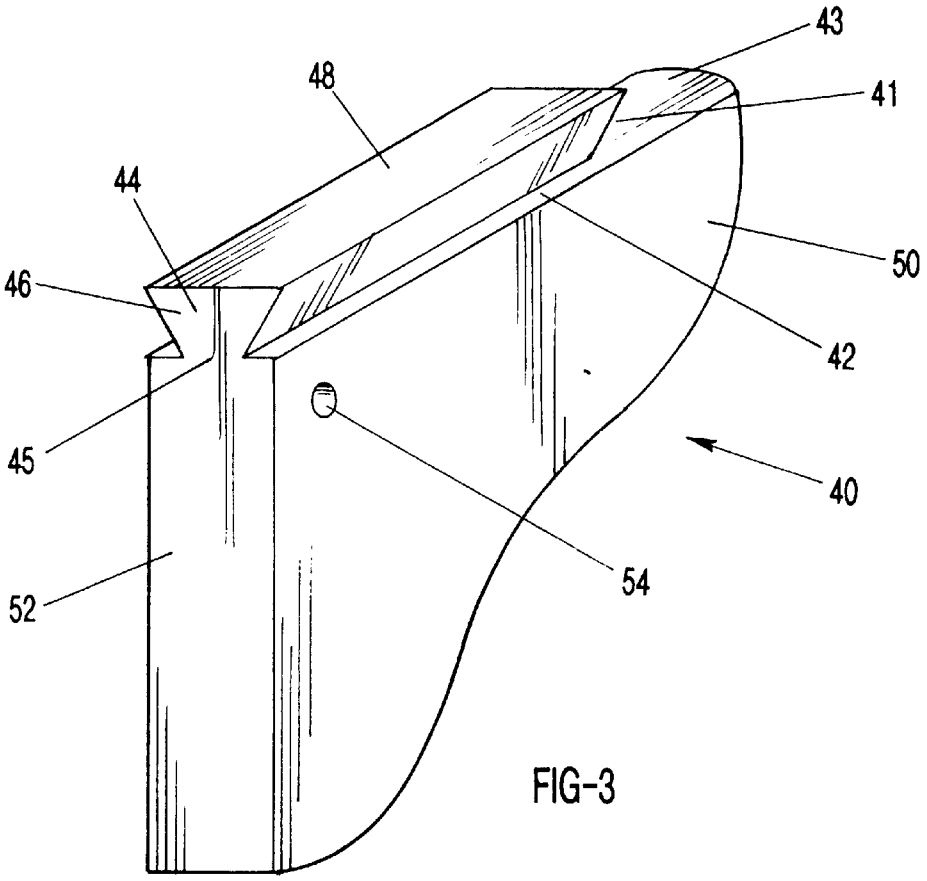
FIG. 3 is a rear perspective view of the shelf support member in accordance with the present invention.

Referring to FIG. 3, shelf support member 40 comprises tenon or tongue 44, preferably a male French dovetail portion, integrally formed at one end of shelf support member 40. Tongue 44 has a reduced neck portion 45 and an enlarged head portion 46 for fitting into correspondingly-shaped groove 21 in shelf member 20. Tongue 44 is complementary and closely conforming to groove 21 in most respects; tongue 44 is of a dovetail cross section when taken along view line A—A of FIG. 4, of uniform height, of the same size and of the same shape as the corresponding dovetail cross section, uniform depth, size and shape of groove 21. Tongue 44 and groove 21 are formed, for example, using a router in a manner well know to those skilled in the art. End 41 of shelf support member 40, however, can differ slightly from groove end 38 of shelf member 20 because of the routing mechanism used to form groove 21. Tongue 44 and groove 21 serve to couple shelf support member 40 to shelf member 20.

Figure 4:
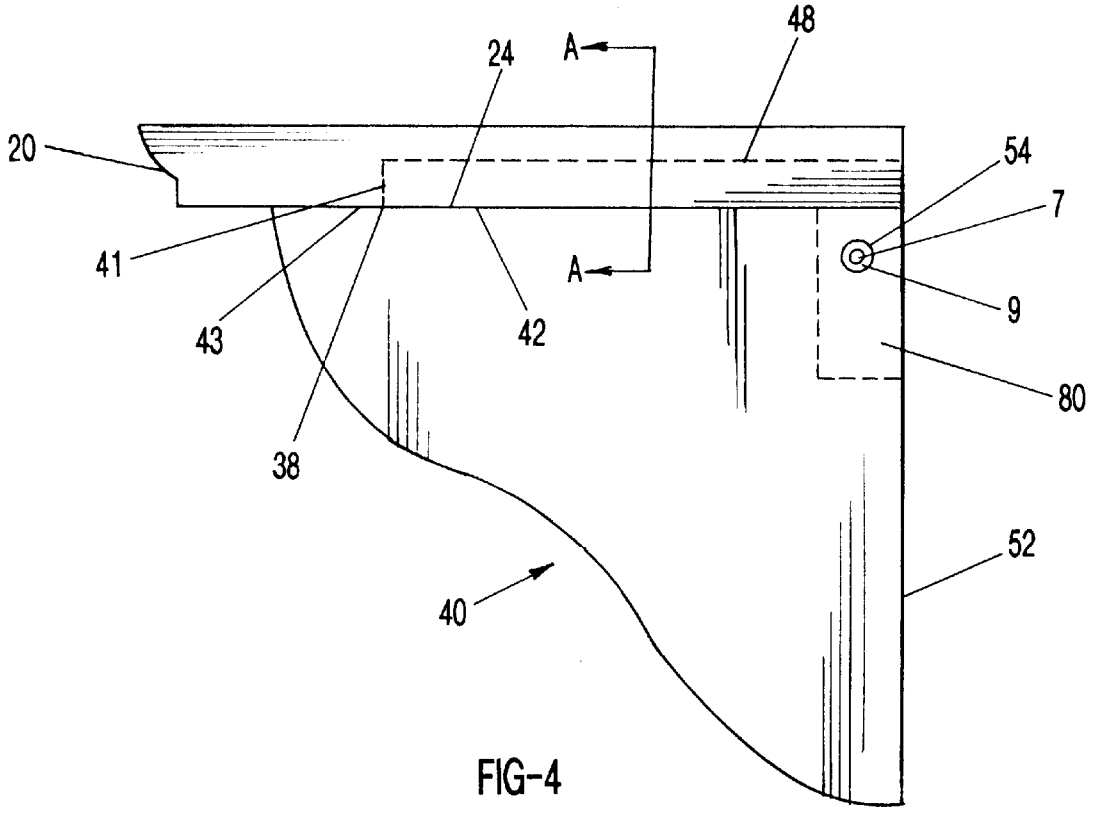
FIG. 4 is a side view of the assembled shelf unit in accordance with the present invention.
Figure 5:
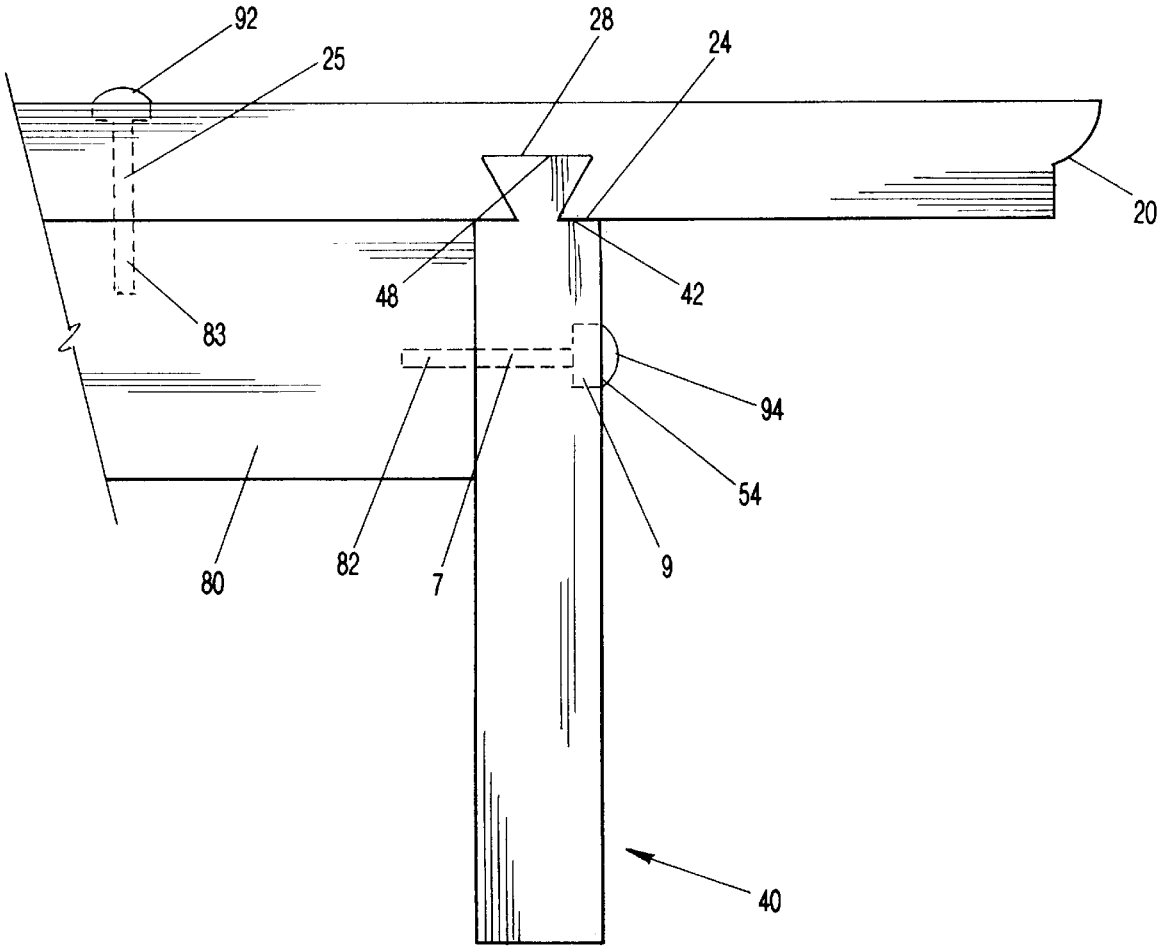
FIG. 5 is an expanded rear view of the assembled shelf unit in accordance with the present invention.

When tongue 44 is inserted and carried in groove 21, shelf support member 40, with respect to shelf member 20, is horizontally removable but vertically immovable-shelf support member 40 becomes securely connected to shelf member 20. The surface 48 of tongue 44 contacts and communicates with the entire surface 28 (see FIG. 2) of groove 21. Surface 42 of shelf support member 40 is flush with underside surface 24 of shelf member 20 as shown in FIG. 4 and 5. Tongue 44 is of the same size and shape as groove 21, thereby defining a shoulder 43 that extends beyond the end 41 of shelf support member 40. Because groove 21 is not routed across the entire width of shelf member 20, and tongue 44 is of the same size and shape as groove 21, end 41 of shelf support member 40 abuts or contacts groove end 38 of groove 21, which causes end 41 of shelf support member 40 to become fixed at groove end 38 as shown in FIG. 4. Tongue 44 snugly enters groove 21 to quickly and efficiently connect and interlock shelf member 20 and shelf support member 40. Tongue 44 mechanically engages groove 21 by sliding into groove 21 to form interlocking shelf unit 100.

After tongue 44 and groove 21 are slidably and mechanically engaged, shelf support member 40 can be secured to back support member 80 by conventional fastening means (not shown), such as by inserting a set screw, nail, bolt, etc., through hole 54 as shown in FIG. 5. Hole 54 is for receiving, for example, the set screw (not shown) that is used to fasten shelf support member 40 to back support member 80, as shown in FIGS. 1 and 5, after shelf support member 40 has been interlocked with shelf member 20. Referring to FIGS. 3–5 inclusive, shelf support member 40 can comprise a countersunk hole 54 formed therethrough. Hole 54, as well as the other fastening holes discussed herein, can be made to form a frusto-conical shaped or tapered portion 9 (shown in FIGS. 1 and 5) at the point of extrusion on outer surface 50 of shelf support member 40, which serves as a seat for the head of fastening means, and a shaft 7 (shown in FIGS. 1 and 5) through shelf support member 40. Tapered portion 9 and shaft 7 are coaxially aligned. Tapered portion 9 serves as a countersink for the head of the set screw, which fits flush in the tapered portion 9 with respect to the outer surface 50 of shelf support member 40, so that the head of the set screw is not exposed. Indeed, the entire assembly of shelf unit 100 has a highly-aesthetic appearance, unmarred by exposed bolt, nail, or screw heads, because the fastening means are hidden from view. Hole 54 of shelf support member 40 is aligned with the hole 82 of back support member 80 as shown in FIG. 5. For a stronger mechanical engagement, an adhesive or glue can be applied between tongue 44 and groove 21 to permanently join shelf member 20 to shelf support member 40. In this configuration, a destructively-releasable fastening and connection means between shelf member 20 and shelf support member 40 is effected.

Additionally, shelf member 20 can be secured to back support member 80 by conventional fastening means (not shown), such as set screws, nails, bolts, etc., through countersunk hole 25 provided in shelf member 20 as shown in FIGS. 2 and 5. Similar to the discussion above, hole 25 of shelf member 20 is aligned with hole 83 of back support member 80 as shown in FIG 1. After back support member 80 has been secured to shelf support member 40 and to shelf member 20, the heads of the set screws (not shown) can then be covered by wood plugs 92 and 94, shown in FIGS. 1 and 5, for a more aesthetically-pleasing appearance. Shelf unit 100 can then be fastened to wall 200 by inserting, for example, set screws (not shown) through countersunk holes 32 and 34 that are provided in back support member 80 as shown in FIG. 1. Shelf support member 40 has a substantially flat rear surface 52, which abuts wall 200 and makes shelf support member 40 horizontally immovable with respect to shelf member 20 when affixed to the supporting surface or wall 200, especially when fasteners are used to secure shelf support member 40 to back support member 80. The set screws, or other conventional fastening means, that secure the back support member 80 to wall 200 can then be covered by wood plugs (not shown) for a more aesthetically-pleasing appearance.

Although shelf member 20 is shown to be generally elongated to illustrate the present invention, it can be of any geometric shape. Additionally, shelf member 20, shelf support member 40, and back support member 80 of shelf unit 100 can be of any design or dimensions, e.g., length, height, or width. In practice, shelf member 20 can be, for example, about 24 inches in length, about 0.75 inches in height, and about 5.5 inches in width; shelf support member 40 can be, for example, about 5 inches in length, about 0.75 inches in height, and about 5 inches in width; and back support member 80 can be, for example, about 16 inches in length, about 0.75 inch in height, and about 1.5 inches in width.

Although the present invention is particularly well suited to be constructed from wood, it is contemplated that the components of shelf unit 100 can be constructed of any material, including resilient materials such as plastic or rigid materials such as metal or stone, that would provide a support surface for objects. It is also contemplated that the novel tongue-and-groove assemblage taught by the present invention can be employed in any structure, e.g., furniture, such as bookshelves, or cabinet making, where two or more substantially perpendicular surfaces are to be joined together and is not limited by the shelf unit structure disclosed herein. Additionally, the present invention can employ any tongue-and-groove joint, including the tapered dovetail joints disclosed by Fata in U.S. Pat. No. 3,090,086.

Because the present invention can be packaged and sold in a "knock-down" configuration and "flat packed," which is easily assembled by the consumer, the present invention minimizes the storage stocking or distribution space required of the vendor. The present invention can be flat packed, which makes it easier to stack and store the shelf units on top of one another. Thus, the present invention is expected to reduce costs associated with the vendor's storage stocking and distribution space. Additionally, the present invention can be quickly and easily assembled and installed by the consumer using only simple tools, such as a screw driver.

Figure 6:
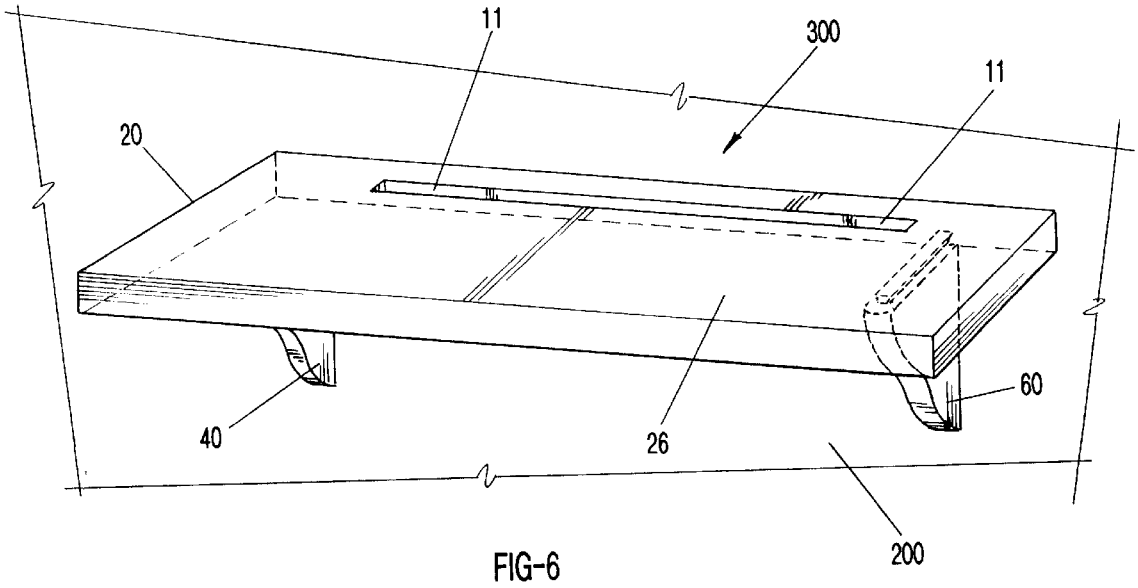
FIG. 6 is a perspective view of an alternate embodiment of the assembled shelf unit, specially adapted as a decorative plate shelf, in accordance with the present invention.

Referring to FIG. 6, in an alternate embodiment, shelf unit 100 can be adapted as a decorative plate shelf 300. The foregoing description of the functional relationships between shelf support member 40, shelf member 20, and back support member 80 applies to this alternate embodiment and need not be discussed again. A longitudinally-extending (lengthwise) groove 11 can be formed in the upperside surface 26 of shelf member 20 substantially across the length of shelf member 20, groove 11 being adapted to receive a decorative plate (not shown). Once groove 11 is formed and shelf unit 100 is fully assembled, the decorative plate (not shown) would rest in groove 11, for example, to be placed on display. Other grooves in other orientations can be formed in the upperside surface 26 of shelf member 20 depending on the application.

Figure 7:
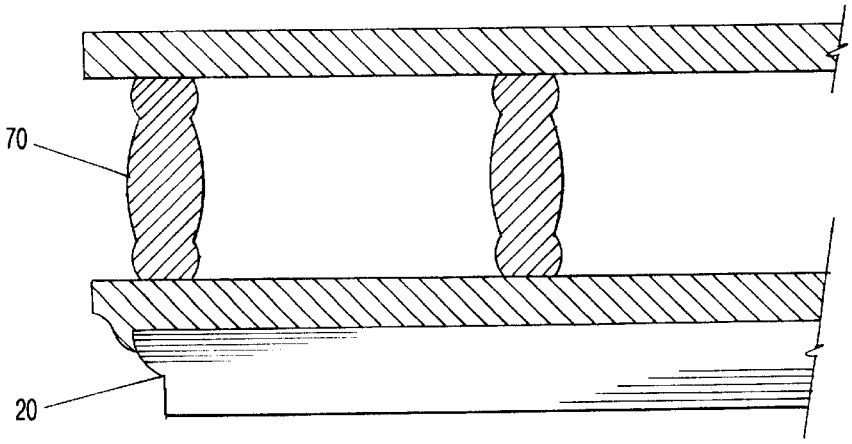
FIG. 7 is an expanded front view of the assembled shelf unit comprising a galley rail in accordance with the present invention.

Other variations and modifications of the present invention will be apparent to those of skill in the art. For example, referring to FIG. 7, shelf member 20 can be constructed to receive galley rail 70 (shown shaded in FIG. 7) that is fastened to shelf member 20. Galley rail 70 serves as a means for ensuring that objects placed on shelf member 20 remain on the shelf, i.e., objects will be retained by galley rail 70 and will not fall off of the shelf. The particular values and configurations discussed above can be varied and are cited merely to illustrate a particular embodiment of the present invention and are not intended to limit the scope of the invention. It is contemplated that the use of the present invention can involve components having different characteristics as long as the principle, the presentation of a joint, a groove formed in a portion of a first member to mechanically engage a tongue of a second member, to form an interlocking unit, is followed. It is intended that the scope of the present invention be defined by the claims appended hereto.

I claim:

1. A shelf unit, the shelf unit comprising:

a shelf member, said shelf member having a plurality of mortises formed in an underside surface of said shelf member, said plurality of mortises extending from a first edge of said shelf member and being open to the first edge of said shelf member, said plurality of mortises being closed at a predetermined stopping point with respect to the first edge of said shelf member thereby defining a length for each of said plurality of mortises;

a plurality of shelf support members, each of said plurality of shelf support members having an upper end, each of said upper ends having a tenon integrally formed thereon with a tenon surface, each of said tenons having an enlarged head portion and a reduced neck portion, each of said tenons having a corresponding mortise selected from said plurality of mortises, each of said tenons having a length corresponding to the length of its said corresponding mortises, each of said tenons being slidably engaged and carried by its said corresponding mortise;

means for joining and interlocking said shelf support member with said shelf support members; and means for securing said shelf support member to said shelf member, wherein the open first edge of said shelf member is no longer open and wherein said shelf support members become immovable in a vertical direction and a horizontal direction with respect to said shelf member.

2. The shelf unit of claim 1, further comprising a back support member disposed between and secured to said plurality of shelf support members.

3. The shelf unit of claim 2, wherein the tenon surface of each of said tenons is formed along a portion thereof to communicate with the entire length of each of said plurality of mortises.

4. The shelf unit of claim 2, wherein the dimensions of each of said tenons conform to the dimensions of each of said plurality of mortises.

5. The shelf unit of claim 4, wherein the tenon surface of each of said tenons communicates with said plurality of mortises along the entire length of said corresponding mortise.

6. The shelf unit of claim 5, wherein said shelf member is joined and interlocked with said plurality of shelf support members in a substantially perpendicular fashion.

7. A shelf unit, the shelf unit comprising:

a shelf member;

at least one shelf support member;

coupling means for securely joining and interlocking said shelf member with said at least one shelf support member, said coupling means comprising a tenon integrally formed at one end of said at least one shelf support member; and a mortise formed in an underside surface of said shelf member, said mortise extending from a first edge of said shelf member and being open to the first edge of said shelf member, said mortise being closed at a predetermined location with respect to the first edge of said shelf member, and said mortise engaging said tenon by sliding and capturing said tenon in said mortise; and locking means for closing the first edge of said shelf member, wherein the at least one shelf support member becomes horizontally and vertically immovable with respect to said shelf member.

8. The shelf unit of claim 7, wherein said tenon has an enlarged head portion and a reduced neck portion.

9. The shelf unit of claim 8, wherein the dimensions of said tenon conform to the dimensions of said mortise.

10. The shelf unit of claim 9, wherein said shelf member is joined and interlocked with said at least one shelf support member in a substantially perpendicular fashion.

* * * * *